US012589283B2

(12) United States Patent
Ebisawa et al.

(10) Patent No.: US 12,589,283 B2
(45) Date of Patent: Mar. 31, 2026

(54) INFORMATION PROVIDING SYSTEM, INFORMATION PROVIDING METHOD, AND NON-TRANSITORY COMPUTER-READABLE MEDIUM STORING PROGRAM

(71) Applicant: Rakuten Group, Inc., Tokyo (JP)

(72) Inventors: Asami Ebisawa, Tokyo (JP); Masahiro Kuwahara, Tokyo (JP)

(73) Assignee: Rakuten Group, Inc., Tokyo (JP)

( * ) Notice: Subject to any disclaimer, the term of this patent is extended or adjusted under 35 U.S.C. 154(b) by 0 days.

(21) Appl. No.: 18/676,742

(22) Filed: May 29, 2024

(65) Prior Publication Data

US 2025/0108272 A1 Apr. 3, 2025

(30) Foreign Application Priority Data

May 31, 2023 (JP) ..... 2023-089672

(51) Int. Cl.
*A63B 57/30* (2015.01)

(52) U.S. Cl.
CPC ..... *A63B 57/357* (2015.10); *A63B 2220/12* (2013.01)

(58) Field of Classification Search
CPC ... A63B 57/00; A63B 57/357; A63B 2220/12; A63B 2220/16; A63B 2220/40; A63B 2024/0025
See application file for complete search history.

(56) References Cited

U.S. PATENT DOCUMENTS

2013/0252633 A1* 9/2013 Liang ..... H04W 52/0251 455/456.1
2015/0066358 A1* 3/2015 Park ..... G01S 19/19 701/431
2015/0186506 A1* 7/2015 Vandevoorde ..... G01S 5/0284 707/737
2015/0281910 A1* 10/2015 Choudhury ..... G01C 21/206 455/456.1
2017/0010359 A1* 1/2017 Jung ..... G01S 17/08

FOREIGN PATENT DOCUMENTS

JP 2022-552494 A 12/2022

* cited by examiner

*Primary Examiner* — James S. McClellan
(74) *Attorney, Agent, or Firm* — Sughrue Mion, PLLC

(57) ABSTRACT

An information providing system includes one or more processors and a memory that stores one or more programs executed by the one or more processors. The one or more programs cause the one or more processors to execute obtaining, for a golf course including greens, position data indicating a position of each of players playing golf on each of the greens, storing the position data in the memory, estimating, from the position data stored in the memory, a cup position on a corresponding one of the greens, and providing the estimated cup position to a user of the golf course.

9 Claims, 7 Drawing Sheets

INFORMATION PROVIDING SYSTEM, INFORMATION PROVIDING METHOD, AND NON-TRANSITORY COMPUTER-READABLE MEDIUM STORING PROGRAM

CROSS-REFERENCE TO RELATED APPLICATIONS

This application is based upon and claims the benefit of priority from prior Japanese Patent Application No. 2023-089672, filed on May 31, 2023, the entire contents of which are incorporated herein by reference.

BACKGROUND

1. Field

The following description relates to an information providing system, an information providing method, and a non-transitory computer-readable medium storing a program.

2. Description of Related Art

Generally, the cup position on each hole of a golf course is changed daily to prevent localized damage to the grass on the green. Japanese Patent Laid-Open No. 2022-552494 discloses an example of a system that detects the cup position on a golf course green from the position data of a greenskeeper who sets the cup on the green.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An information providing system according to an aspect of the present disclosure includes one or more processors and a memory that stores one or more programs executed by the one or more processors. The one or more programs cause the one or more processors to execute obtaining, for a golf course including greens, position data indicating a position of each of players playing golf on each of the greens, storing the position data in the memory, estimating, from the position data stored in the memory, a cup position on a corresponding one of the greens, and providing the estimated cup position to a user of the golf course.

An information providing method according to an aspect of the present disclosure includes obtaining, by one or more computers, for a golf course including greens, position data of each of players playing golf on each of the greens, estimating, by the one or more computers, from the position data, a cup position on a corresponding one of the greens, and providing, by the one or more computers, the cup position to a user of the golf course.

A non-transitory computer-readable medium according to an aspect of the present disclosure stores a program for causing one or more computers to execute obtaining, for a golf course including greens, position data of a position of each of players playing golf on each of the greens, estimating, from the position data, a cup position on a corresponding one of the greens, and providing the cup position to a user of the golf course.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

First Embodiment

An information providing device, an information providing system, an information providing method, and a program according to an embodiment will now be described.

Configuration of Information Providing System 10

Figure 1:
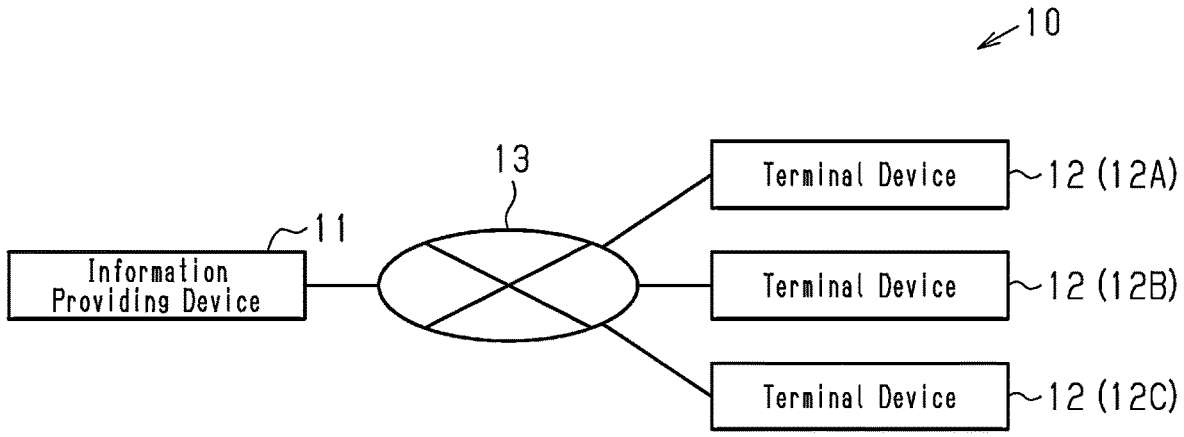
FIG. 1 is a diagram illustrating an overall configuration of an information providing system according to a first embodiment.

As shown in FIG. 1, the information providing system 10 provides a user with various types of information, particularly information indicating cup positions on a golf course.

In this embodiment, the golf course includes multiple holes. Each hole has a green. Each green includes a cup. The position where the cup is located on the green is referred to as a cup position. Golf is a sport in which players compete by counting the number of strokes taken to get the ball from the tee shot on the teeing ground into the cup on the green at each hole. Thus, a cup position is a factor that affects not only the difficulty level of a round of golf, but also affects the overall performance results.

The information providing system 10 includes an information providing device 11. The information providing device 11 is, for example, a server for providing the user with information. The user to whom the information is provided may be a golf course manager or a player who is playing golf on the golf course. The information providing system 10 may include one or more terminal devices 12. For example, multiple terminal devices 12 may include a first terminal device 12A, a second terminal device 12B, and a third terminal device 12C.

The information providing device 11 and one or more terminal devices 12 are connected in a manner that allows communication via a network 13. At least some of the information providing device 11 and the terminal devices 12 may be connected in a manner that allows direct communication without using an external network, such as the Internet. Hereinafter, description of communication between the devices via the network 13 will be omitted.

Configuration of Terminal Device 12

Figure 2:
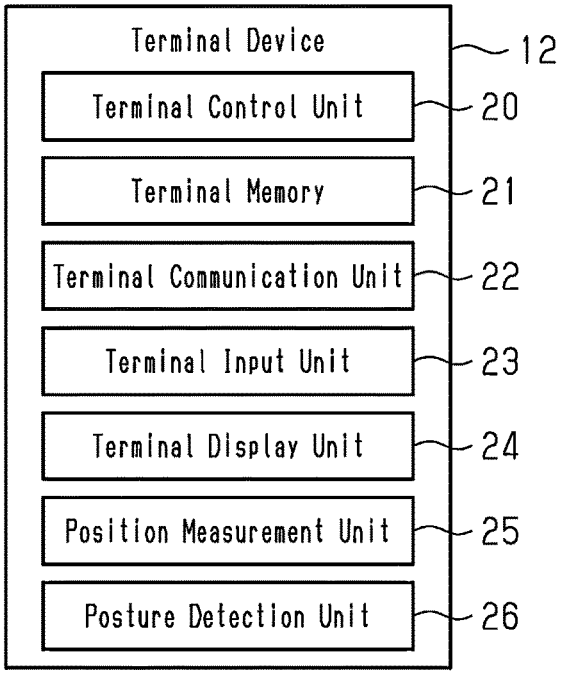
FIG. 2 is a diagram illustrating an electrical configuration of a terminal device according to the first embodiment.

Each of the terminal devices 12 shown in FIG. 2 is used by multiple users who utilize the information providing system 10. Each of the terminal devices 12 may be used by multiple players (golfers). Multiple users may be multiple players. These players may, for example, belong to the first group on a specific round day. The terminal device 12 may be a mobile terminal device that can be carried by a player. The mobile terminal device may be a wearable device that can remain worn during golf play (e.g., a smartwatch that can be worn on the wrist). In this case, the terminal devices 12 are used by multiple players even during golf play.

The terminal devices 12 obtain various types of data from the information providing device 11 in response to an information providing request. The terminal device 12 obtains data related to golf in the information providing system 10. Each terminal device 12 may be a small-sized computer.

Each terminal device 12 includes a terminal control unit 20, a terminal memory 21, a terminal communication unit 22, a terminal input unit 23, and a terminal display unit 24. The terminal control unit 20 is configured to control the terminal device 12. The terminal control unit 20 includes an arithmetic logic unit and a main storage medium. The arithmetic logic unit loads an operating system (OS) and programs from the terminal memory 21 into the main storage medium and executes instructions retrieved from the main storage medium. The arithmetic logic unit includes circuitry. The circuitry may include one or more processors, and the processors may include a central processing unit (CPU), a graphic processing unit (GPU), or a neural network processing unit (NPU).

The terminal memory 21 is a sub-storage medium that stores data related to multiple users, (e.g., players). The terminal memory 21 may store a program for sending and receiving data related to golf. The program may be a dedicated application for utilizing the information providing system 10.

The terminal communication unit 22 is implemented as hardware, software, or a combination thereof. The terminal communication unit 22 sends and receives data to and from the information providing device 11. The terminal input unit 23 is configured to input information in response to operation performed by a user. The terminal input unit 23 may be a touch screen integrated with the terminal display unit 24. The terminal input unit 23 may be a pointing device for an operation button. The terminal display unit 24 displays information in response to an output instruction from the terminal control unit 20.

Each terminal device 12 includes a position measurement unit 25. The position measurement unit 25 obtains the position data of the terminal device 12 by measuring the position of the terminal device 12. The position measurement unit 25 may be a global positioning system (GPS) sensor.

The terminal device 12 includes a posture detection unit 26. The posture detection unit 26 detects the posture of a player who is wearing the terminal device 12. The posture detection unit 26 may include a sensor. The sensor can be either an angular velocity sensor or an accelerometer.

Configuration of Information Providing Device 11

Figure 3:
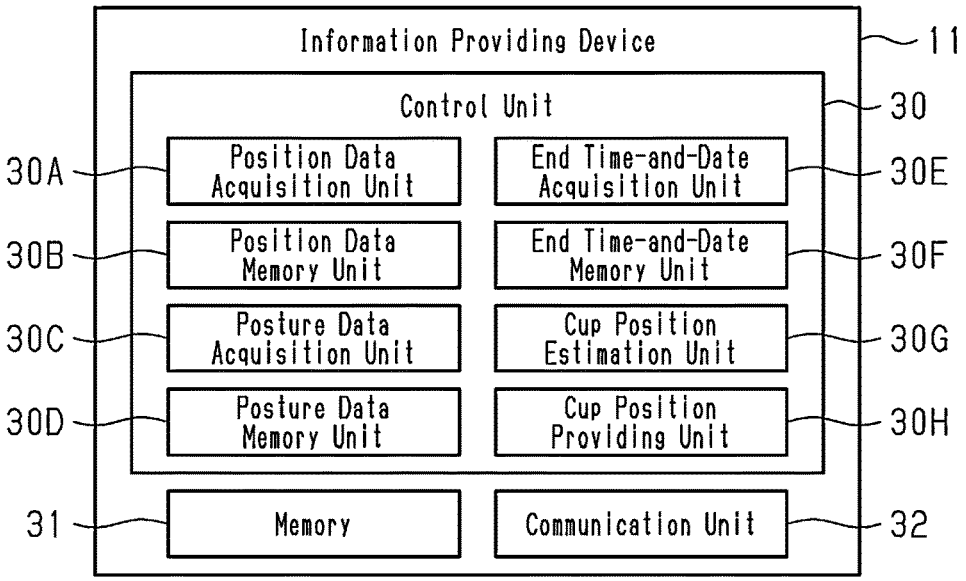
FIG. 3 is a diagram illustrating an electrical configuration of the information providing device in the first embodiment.

As shown in FIG. 3, the information providing device 11 is a server that provides a user with various types of information through communication with the terminal device 12. For example, the information providing device 11 provides a player or a golf course manager with information related to golf. The provided information may include the cup position of each of the holes in the golf course. The information providing device 11 is managed by a provider who provides information related to golf.

The information providing device 11 includes a control unit 30, a memory 31, and a communication unit 32. The control unit 30 is configured to control the information providing device 11. The control unit 30 includes an arithmetic logic unit and a main storage medium. The control unit 30 has the same configuration as the terminal control unit 20. Thus, the arithmetic logic unit and the main storage medium will not be described. The memory 31 is an auxiliary storage medium that stores data used to manage the information providing device 11.

The communication unit 32 is implemented as hardware, software, or a combination thereof. The communication unit 32 sends and receives data to and from the terminal device 12. The information providing device 11 may include an operation unit operated by a provider to input information, or may include a display unit that displays information.

By executing a program, the control unit 30 operates as a position data acquisition unit 30A, a position data memory unit 30B, a posture data acquisition unit 30C, a posture data memory unit 30D, an end date-and-time acquisition unit 30E, an end date-and-time memory unit 30F, a cup position estimation unit 30G, and a cup position providing unit 30H.

The position data acquisition unit 30A obtains the position data of multiple players. Specifically, the position data acquisition unit 30A obtains the position data of multiple players by receiving the position data from each of the terminal devices 12. The position data memory unit 30B stores, in the memory 31, the position data obtained by the position data acquisition unit 30A. The position data memory unit 30B stores the position data of the player carrying (or wearing) each terminal device 12 in the memory 31, in association with date-and-time data indicating when the position data was obtained and a user identifier representing that player. The user identifier is set to identify the player carrying the terminal device 12.

The user identifier may be used to identify applications installed on the terminal device 12. The application may be an application that is activated during golf play. The application may include a program for managing golf scores. The user identifier may be used to identify a user (player) set in the application. The user identifier may also be used to identify the user (player) that is set for the terminal device 12.

The posture data acquisition unit 30C obtains posture data from multiple players. Specifically, the posture data acquisition unit 30C obtains the posture data of multiple players by receiving the posture data from each of the terminal devices 12. The posture data memory unit 30D stores, in the memory 31, the posture data obtained by the posture data acquisition unit 30C. Particularly, the posture data memory unit 30D stores the posture data of the player carrying (or wearing) each mobile terminal 12 in the memory 31, in association with date-and-time data indicating when the posture data was obtained and a user identifier representing that player.

The end date-and-time acquisition unit 30E obtains the end time and date at which each of the players completed a hole. When determining that each player has completed each hole based on the position data of the player, the end date-and-time acquisition unit 30E obtains the end date and time. The end date-and-time memory unit 30F stores, in the memory 31, the end date and time obtained by the end date-and-time acquisition unit 30E. Particularly, the end date-and-time memory unit 30F stores the end date and time in the memory 31 in association with the user identifier of a corresponding player.

The cup position estimation unit 30G estimates the cup position of each hole. The cup position estimation unit 30G estimates the cup position from the position data of multiple players stored in the memory 31. The cup position providing unit 30H provides other users with the cup position estimated by the cup position estimation unit 30G. For example, if multiple players who provided the position data used to estimate the cup position belong to the first group on a specific round day, the estimated cup position is provided to players belonging to the second and subsequent groups on the same round day.

Cup Position Estimation Method

Figure 4:
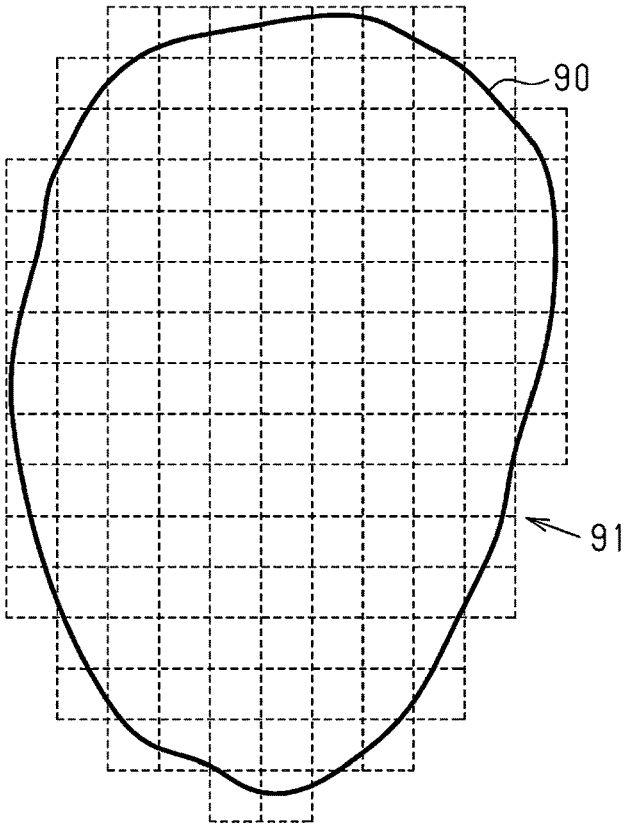
FIG. 4 is a diagram illustrating multiple divided sections assigned to the green in the first embodiment.

As shown in FIG. 4, the area including a green area 90 is divided into multiple divided sections 91. Each of the divided sections 91 is arranged in a matrix form. Each of the divided sections 91 is a square with a predetermined side length, but the shape is not limited to a square. For example, the length of one side may be one meter, but this is not limited to that length.

The cup position estimation unit 30G estimates, as the cup position, one of the divided sections 91 where the largest number of players on the green were present during a given play period. The play period may be, for example, a time when the first group of players are present on the green. After the players hit the ball onto any one of the divided sections 91, they gradually approach the cup position until the ball is holed. Then, after the ball has entered the cup at the hole, each player bends down to pick the ball up from the cup. Thus, the cup position is likely to be in an area on the green where a large number of players are present during play. Taking this possibility into account, the cup position estimation unit 30G estimates, as the cup position, one of the divided sections 91 where the largest number of players were present during a play period. The cup position estimation unit 30G may estimate the cup position a number of times within a predetermined period. The predetermined period corresponds to the interval from a change in the cup position to another change in the cup position. For example, this period may be one day.

Cup Position Providing Process

The cup position providing process will now be described with reference to FIG. 5. The cup position providing process provides players playing holes on a specific day with the cup positions of the hole on that day. The cup position providing process is executed by the control unit 30 of the information providing device 11 at an interval for each of the holes.

Figure 5:
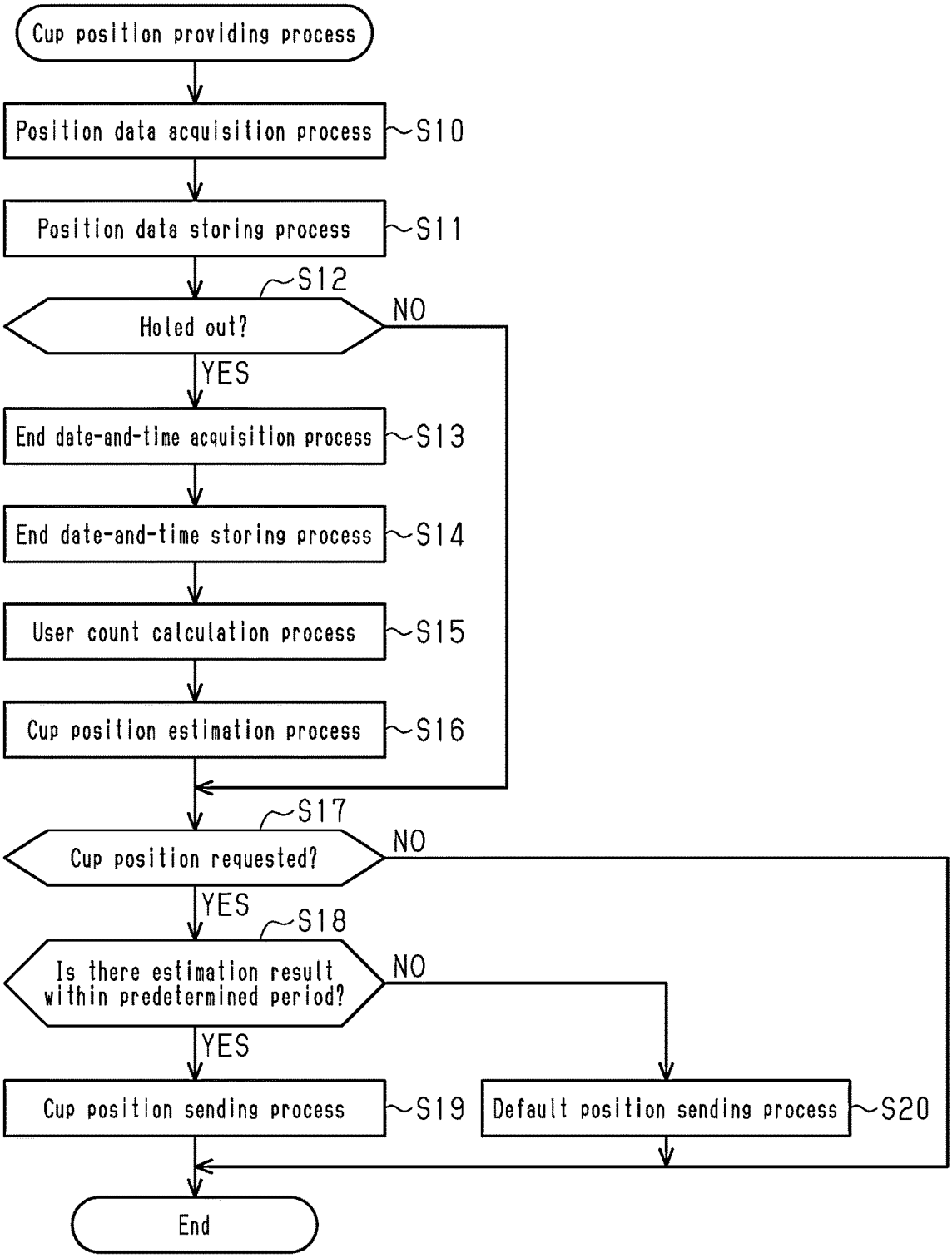
FIG. 5 is a flowchart illustrating the cup position providing process in the first embodiment.

As shown in FIG. 5, in step S10, the control unit 30 executes the position data acquisition process. In the position data acquisition process, the control unit 30 communicates with the terminal device 12 to receive user identifiers for multiple players belonging to a group playing together and the position data of those players. As a result, the control unit 30 obtains the user identifiers and position data of one group. In this state, the control unit 30 obtains the current date-and-time data.

In step S11, the control unit 30 executes a position data storing process. In the position data storing process, the control unit 30 stores the obtained position data in the memory 31. Specifically, the control unit 30 stores the obtained user identifiers, position data, and current date-and-time data in the memory 31 in association with each other.

In step S12, for each player of the group, the control unit 30 determines whether the player in the group has holed out on that hole based on the user identifiers and position data stored in the memory 31. For example, the control unit 30 determines that the user has holed out on a first hole when the position data associated with the user identifier indicates a position heading from the first hole toward a second hole. When determining that the player has not holed out, the control unit 30 advances the process to step S17. When determining that the player has holed out, the control unit 30 advances the process to step S13.

In step S13, the control unit 30 executes the process to obtain an end date-and-time acquisition process. In the end date-and-time acquisition process, the control unit 30 obtains a target user identifier, a hole identifier that can identify the golf course and holes, and the current date-and-time data. Particularly, the control unit 30 obtains the current date-and-time data as the end date and time at which the player completed the hole.

In step S14, the control unit 30 executes an end date-and-time storing process. In the end date-and-time storing process, the control unit 30 stores the obtained end date and time in the memory 31. Specifically, the control unit 30 stores the obtained user identifier, hole identifier, and end date and time in the memory 31 in association with each other.

In step S15, the control unit 30 executes a user count calculation process. In the user count calculation process, the control unit 30 identifies the play period based on the current date-and-time data. Specifically, the control unit 30 identifies the duration from when a group reaches a green to when they hole out as the play period, based on the current date-and-time data.

Based on the user identifier and position data, the control unit 30 calculates the number of players who were present in the play period within each of the divided sections 91 that include the green of the holed-out hole.

In step S16, the control unit 30 executes a cup position estimation process. In the cup position estimation process, the control unit 30 may refer to the calculation result to estimate, as the cup position, one of the divided sections 91 where the largest number of players were present. Instead, the control unit 30 may estimate, as the cup position, one of the divided sections 91 that includes the centroid of the distribution of players. In other words, the control unit 30 estimates one of the divided sections 91 as the cup position based on the position data of multiple players during the play period. The control unit 30 stores the estimated cup position, hole identifier, and date-and-time data in the memory 31 in association with each other.

Thus, the control unit 30 estimates the cup position when the groups have completed each of multiple holes. Further, each time a group completes one hole, the control unit 30 estimates the cup position and updates the estimated cup position. Thus, the initial cup position can be estimated when the first group holes out. Subsequently, the cup position can be updated when the second group holes out. In this manner, the data forming the basis for estimation accumulates. As a result, the accuracy of cup position estimation increases each time the cup position is updated.

In step S17, the control unit 30 communicates with each of multiple terminal devices 12 to determine whether any player has requested the cup position. The terminal device 12 may request the cup position for the information providing device 11 when a course is designated during the startup of the application. During the startup of the application, each terminal device 12 may request the cup position from the information providing device 11 in response to an operation by a corresponding player. Player operations may include designating the cup position for one or more holes and may include an operation to collectively request the cup positions for all holes. When the control unit 30 determines that none of the players has requested the cup position, it terminates the cup position providing process. When determining that one player has requested the cup position, the control unit 30 advances the process to step S18.

In step S18, the control unit 30 determines whether there is an estimation result within a predetermined period. The control unit 30 determines that there is an estimation result within the predetermined period when the estimated cup position for the predetermined period is stored in the memory 31. When determining that there is an estimation result within the predetermined period, the control unit 30 advances the process to step S19. When determining that there is no estimation result within the predetermined period, the control unit 30 advances the process to step S20.

In step S19, the control unit 30 executes a cup position sending process. In the cup position sending process, the control unit 30 reads the latest cup position (the initial cup position or the updated cup position) from the memory 31. The control unit 30 sends the read cup position to the terminal device 12 that requested the cup position. As a result, the control unit 30 provides the estimated cup position to the player. For example, when one player belonging to the second group requests the cup position of the first hole before starting play on the first hole, that player is provided with the initial cup position that was estimated when the first group holed out. When the control unit 30 completes the cup position sending process, it terminates the cup position providing process.

In step S20, the control unit 30 executes a default position sending process. In the default position sending process, the control unit 30 reads a predetermined default cup position from the memory 31. The control unit 30 sends the read cup position to the terminal device 12 that requested the cup position. As a result, the control unit 30 provides the predetermined default cup position (also referred to as a default position) when the cup position has not been estimated within the predetermined period. The default position may be, for example, the center of the green. For example, when the first group starts playing at the first hole, the cup position on that green has not been estimated. Thus, the default cup position is generally provided to the first group. When the control unit 30 completes the cup position sending process, it terminates the cup position providing process.

Operation of First Embodiment

The operation of the first embodiment will now be described.

Figure 6:
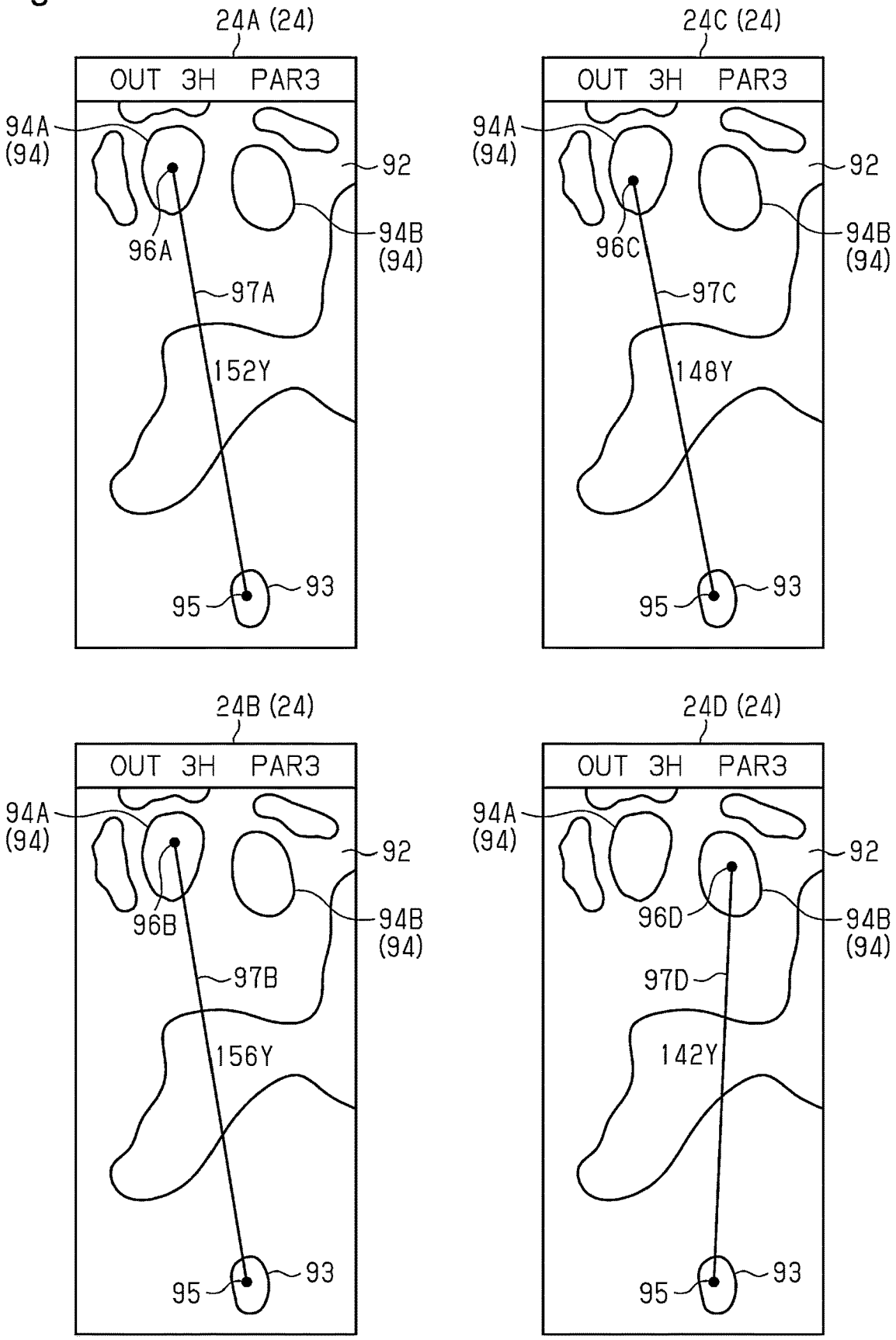
FIG. 6 is a diagram illustrating images displayed on the terminal display unit of the first embodiment.

As shown in FIG. 6, there are instances when the terminal display unit 24 displays a first screen 24A. The first screen 24A displays a layout image 92 of the golf course. The layout image 92 includes a teeing ground image 93 of the course. The layout image 92 includes a green image 94 of the course.

Some golf course holes include two greens. In such a case, if a cup is installed on one green, the other green is an alternate green without a cup. In this case, the layout image 92 may include a first green image 94A, which indicates a first green, and a second green image 94B, which indicates a second green.

In the first screen 24A, a user position image 95, a first cup position image 96A, and a first distance image 97A are superimposed and displayed on the layout image 92. The user position image 95 indicates the current position of the user. The first cup position image 96A indicates the cup position. The first distance image 97A indicates a straight line and the distance (152 yards) connecting the user current position with the cup position.

The first screen 24A illustrates an example where the default position for the cup is provided by the information providing device 11 as the cup position. Thus, the first screen 24A displays a first cup position image 96A indicating the default position. The first cup position image 96A indicates the cup position at the center of the first green image 94A.

The terminal display unit 24 may display a second screen 24B. In the second screen 24B, the user position image 95, a second cup position image 96B, and a second distance image 97B are superimposed and displayed on the layout image 92.

The second screen 24B illustrates an example where the estimated cup position is provided by the information providing device 11. For this reason, unlike the first screen 24A, the second screen 24B displays the second cup position image 96B indicating the estimated cup position. The second cup position image 96B indicates the cup position at a position farther from the teeing ground in the first green image 94A than the first cup position image 96A. Thus, the distance of the second distance image 97B indicates 156 yards.

A third screen 24C illustrates an example of a screen displayed on the terminal display unit 24 on a different day than the second screen 24B. In the third screen 24C, the user position image 95, a third cup position image 96C, and a third distance image 97C are superimposed and displayed on the layout image 92.

The third screen 24C illustrates an example where the estimated cup position is provided by the information providing device 11. The third cup position image 96C displays the estimated cup position at a position that differs from the default position and the second screen 24B. The third cup position image 96C indicates the cup position at a position closer to the teeing ground in the first green image 94A than the first cup position image 96A. Thus, the distance of the third distance image 97C indicates 148 yards.

Additionally, the terminal display unit 24 may display a fourth screen 24D. In the fourth screen 24D, the user position image 95, a fourth cup position image 96D, and a fourth distance image 97D are superimposed and displayed on the layout image 92.

The fourth screen 24D illustrates an example where the estimated cup position is provided by the information providing device 11. For this reason, unlike the first screen 24A, the fourth screen 24D displays the fourth cup position image 96D indicating the estimated cup position. The second green image 94B indicates the cup position located on the second green.

Advantages of First Embodiment

The first embodiment has the following advantages.

(1-1) The control unit 30 refers to the position data of multiple players on the day of play to estimate, as the cup position, one of the divided sections 91 obtained by dividing an area that includes a green. The control unit 30 provides the estimated cup position to the players who will play on the green afterward. Thus, since many players approach the cup position on the green of each hole, the position data of the group ahead is used to provide the group behind with one of the divided sections 91 as the cup position. This eliminates the need for the golf course manager to use a dedicated system to provide the cup position.

The present disclosure eliminates the need for staff such as the golf course manager or greenskeeper to check the cup position or inform players of the cup position. This reduces the burden on the manager. In addition, neither the player nor the staff needs to perform any operation to input the known cup position into the information providing device 11 in order to provide the cup position. The terminal device 12 carried by each player automatically sends the position data of that player to the information providing device 11. As a result, the information providing device 11 estimates the cup position in real time. This informs the player of the latest cup position on the day of play while also reducing the burden on the player or staff. Accordingly, the convenience for the player is improved.

(1-2) The control unit 30 may estimate, as the cup position, one of the divided sections 91 where the largest number of players were present. This allows the cup position to be properly estimated even if the number of players on the green during the play period varies or if the balls used by players each landed in a different position.

(1-3) The control unit 30 may estimate, as the cup position, one of the divided sections 91 that includes the centroid of the distribution of players. This allows for cup position estimation using a calculation formula for determining the centroid.

(1-4) Each time a player of one group completes a hole, the control unit 30 estimates the cup position of the hole. Thus, each time the group behind completes that hole, the cup position is updated. As a result, within the predetermined period, the greater the number of users who have obtained position data, the higher the accuracy in estimating the cup position.

(1-5) The control unit 30 can provide the user with a predetermined cup position when the cup position has not been estimated.

Second Embodiment

A second embodiment will now be described. In the second embodiment, when the cup position of each hole has not been estimated, the cup position does not have to be provided. In the description below, the same reference numerals are given to those components that are the same as the corresponding components of the above embodiment. Such elements will not be described or will be briefly described.

Cup Position Providing Process

Figure 7:
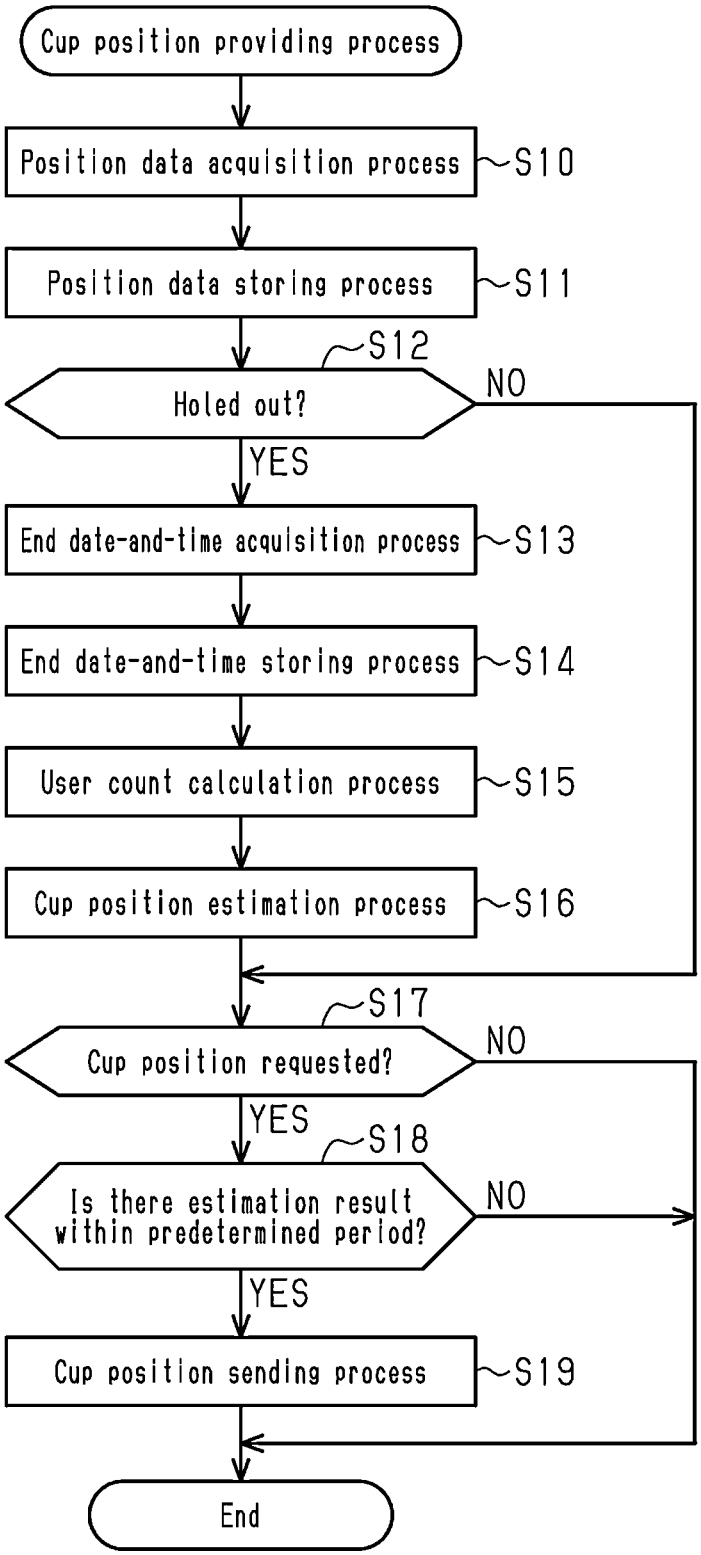
FIG. 7 is a flowchart illustrating the cup position providing process in a second embodiment.

As shown in FIG. 7, in step S18, when determining that there is no estimation result within a predetermined period, the control unit 30 of the information providing device 11 terminates the cup position providing process without executing step S20. As a result, the control unit 30 does not provide a cup position when the cup position has not been estimated within the predetermined period.

Advantage of Second Embodiment

The second embodiment has the following advantages.

(2-1) The control unit 30 does not provide a cup position when the cup position has not been estimated within the predetermined period. Thus, even if the default position differs from an actual cup position, the user is prevented from mistakenly identifying the cup position.

Third Embodiment

A third embodiment will now be described. In the third embodiment, position data is used to generate movement paths respectively corresponding to players. As a result, the area where the movement paths intersect a large number of times may be estimated as the cup position.

Cup Position Providing Process

Figure 8:
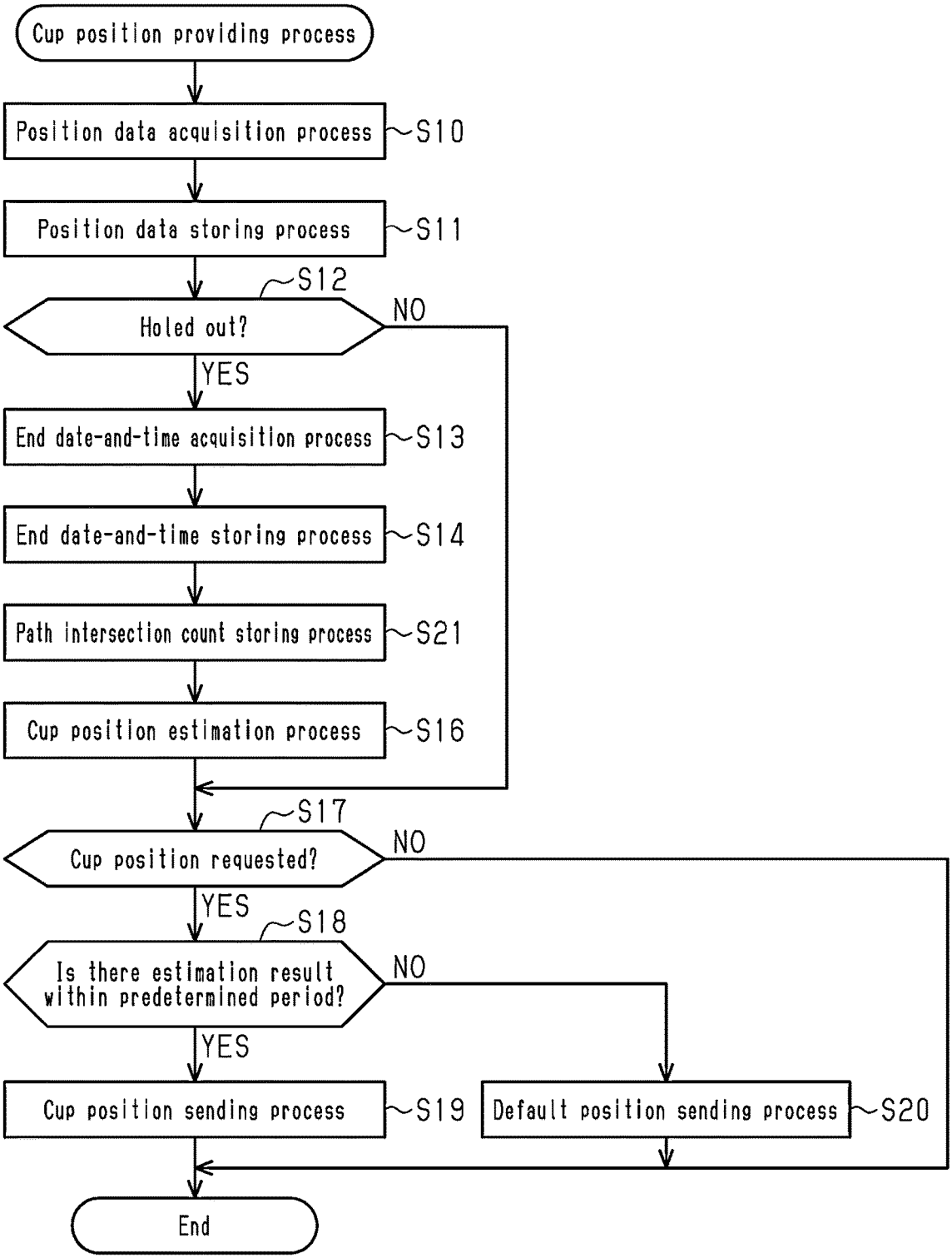
FIG. 8 is a flowchart illustrating the cup position providing process in a third embodiment.

As shown in FIG. 8, when step S14 is completed. the control unit 30 of the information providing device 11 advances the process to step S21. In step S21, the control unit 30 executes a path intersection count calculation process instead of the user count calculation process. In the intersection count calculation process, the control unit 30 identifies the play period based on the current date-and-time data.

Based on the user identifier and position data, the control unit 30 generates the movement paths of players during a play period on the green where they have holed out. Based on the generated movement paths, the control unit 30 calculates the number of times the movement paths intersected in each of the divided sections 91.

In step S16, the control unit 30 refers to the calculation result to estimate, as the cup position, one of the divided sections 91 where the movement paths intersected the largest number of times. In other words, the control unit 30 estimates one of the divided sections 91 as the cup position based on the position data of the players. The control unit 30 stores the estimated cup position, hole identifier, and date-and-time data in the memory 31 in association with each other.

Advantage of Third Embodiment

The third embodiment has the following advantages.

(3-1) The control unit 30 estimates, as the cup position, one of the divided sections 91 where the movement paths intersected the largest number of times. This allows for cup position estimation using movement paths that indicate players are approaching the cup.

Fourth Embodiment

A fourth embodiment will now be described. In the fourth embodiment, the cup position may be estimated from the posture data of players. In particular, in the fourth embodiment, the cup position may be estimated from the players having bent down.

Cup Position Providing Process

Figure 9:
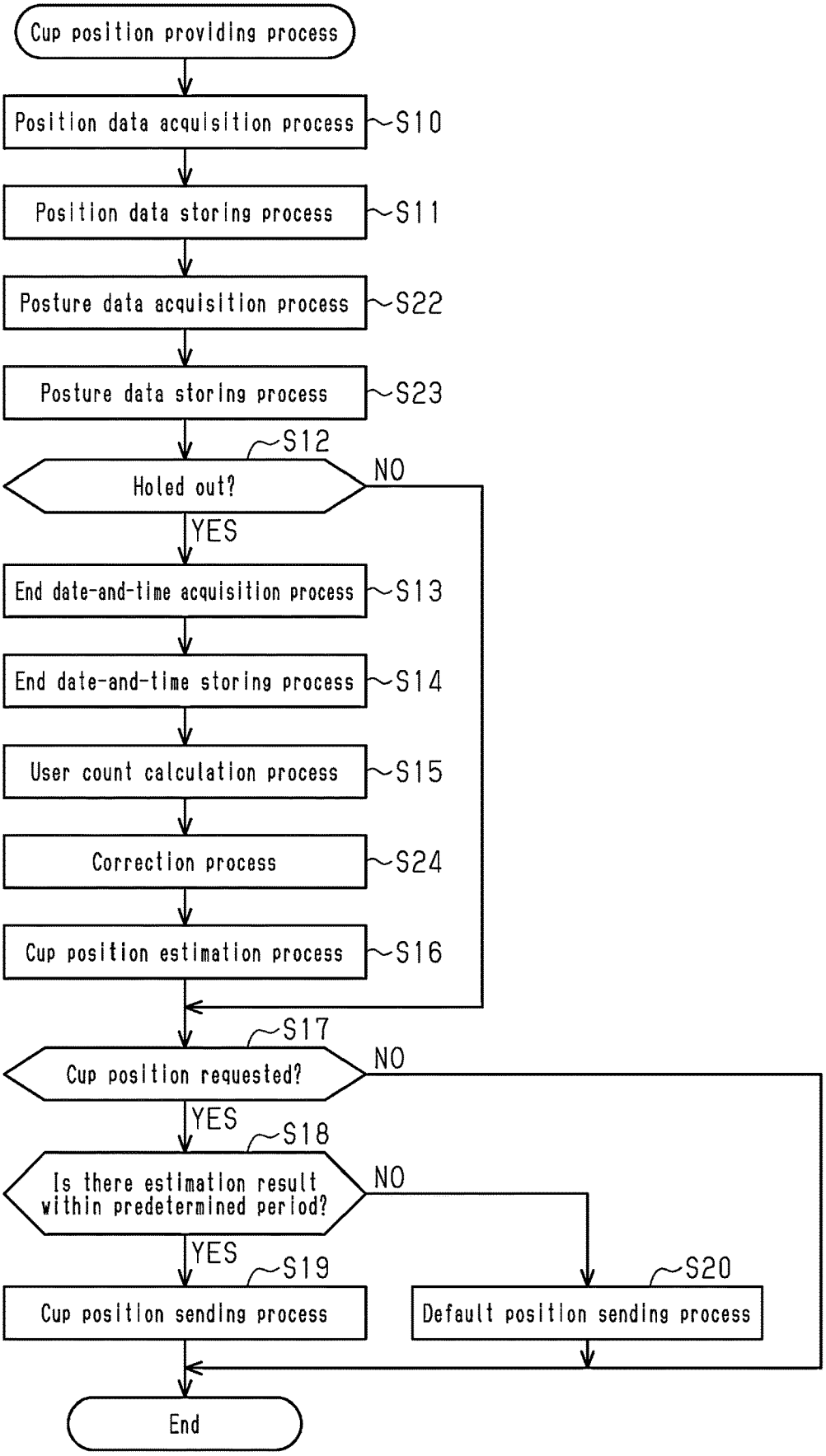
FIG. 9 is a flowchart illustrating the cup position providing process in a fourth embodiment.

As shown in FIG. 9, when step S11 is completed. the control unit 30 of the information providing device 11 advances the process to step S22. In step S22, the control unit 30 executes a posture data acquisition process. In the posture data acquisition process, the posture data and user identifier for each of the players are received through communication with multiple terminal devices 12. As a result, the control unit 30 obtains the user identifier and the posture data. Further, the control unit 30 obtains the current date-and-time data.

In step S23, the control unit 30 executes a posture data storing process. In the posture data storing processing, the control unit 30 stores the obtained posture data in the memory 31. Specifically, the control unit 30 stores the obtained user identifier, posture data, current date-and-time data, and the position data obtained in step S10 for each of the players in the memory 31 in association with each other. When the posture data storing process is completed, the control unit 30 advances the process to step S12.

When step S15 is completed, the control unit 30 advances the process to step S24. In step S24, the control unit 30 executes a correction process. In the correction process, the control unit 30 makes corrections for the result calculated in step S15.

In particular, the control unit 30 may perform corrections based on the posture data. Specifically, the control unit 30 refers to the user identifier, posture data, position data, and date-and-time data to extract the position data of a player who has bent down during a play period on the green of the holed-out hole. For each of the divided sections 91, the control unit 30 calculates the number of players who have bent down during the play period.

The control unit 30 corrects the result calculated in step S15 with the number of players who have bent down. Specifically, the control unit 30 may correct the result calculated in step S15 such that a divided section 91 with a higher number of players who have bent down is emphasized more than a divided section 91 with a smaller number of players who have bent down.

For example, the control unit 30 may perform corrections to calculate, for each of the divided sections 91, the number of players who have bent down during the play period out of the number of users present in each area during the play period. Instead, the control unit 30 may perform corrections to add, for each of the divided sections 91, the number of players who have bent down during the play period to the number of players present in each area during the play period.

In step S16, the control unit 30 refers to the correction result of step S24 to estimate, as the cup position, one of the divided sections 91 that has the highest priority. Thus, the control unit 30 refers to the posture data of players to estimate the cup position as the divided section 91 where a larger number of players have bent down.

Advantage of Fourth Embodiment

The fourth embodiment has the following advantages.

(4-1) Players bend down to pick up the ball from the cup after it goes into the cup on each hole. In view of the characteristics of player actions, the control unit 30 refers to the posture data of players to estimate the cup position as the divided section 91 where a larger number of players have bent down. This allows for improved accuracy in cup position estimation.

Modifications

The present embodiments may be modified as follows. The present embodiment and the following modifications can be combined as long as they remain technically consistent with each other.

Even if the default position is provided as the cup position by the information providing device 11, the terminal device 12 does not have to display the cup position on the terminal display unit 24. Even if the information providing device 11 does not provide the cup position, the terminal device 12 may cause the terminal display unit 24 to display, as the cup position, a default position determined in advance in an application.

Instead of displaying an image of the cup position provided by the information providing device 11, the terminal device 12 may display an image that indicates the possibility that the cup position was provided by the information providing device 11. For example, the terminal device 12 may display a heat map image that indicates the possibility that the cup position was provided by the information providing device 11.

The control unit 30 may estimate the cup position at any interval, not limited to when a particular group has holed out. The control unit 30 does not have to estimate the cup position when a particular group has holed out. Instead, the control unit 30 may estimate the cup position when the number of players on the green exceeds a predetermined number. Alternatively, the control unit 30 may provide the estimated cup position if the number of persons who have provided the position data used for estimating the cup position (the cumulative number of players who have played on the green) reaches or exceeds a predetermined number.

The terminal device 12 may include some of the functions of the information providing device 11. In other words, the information providing system 10 may distribute the functions of the information providing device 11 between the information providing device 11 and the terminal device 12.

The information providing system 10 may include a reward granting device that grants rewards to players when a reward granting condition is satisfied. The reward granting device may provide rewards to players who have launched an application and provided position data. The reward granting device may grant points to the player as a reward. Points may be used to pay for purchase fees in electronic commerce. Points may be used to pay for the golf course fees. The information providing device 11 may be separate from the reward granting device but may also function to grant rewards to the player.

Clauses

The technical ideas understood from the embodiments and modifications and their operational advantages will now be described below.

[Clause 1]

An information providing device, including:

a position information acquisition unit that obtains position information of a user;

a position information memory unit that stores the position information of the user obtained by the position information acquisition unit;

a cup position estimation unit that estimates a cup position from position information of multiple users stored in the position information memory unit within a predetermined period; and a cup position providing unit that provides the user with the cup position estimated by the cup position estimation unit.

[Clause 2]

In the information providing device, where the cup position estimation unit estimates, as the cup position, one of divided sections assigned to a green based on the position information of the users stored in the position information memory unit within the predetermined period.

[Clause 3]

In the information providing device, where the cup position estimation unit estimates, as the cup position, one of the divided sections where the largest number of users were present within the predetermined period.

[Clause 4]

In the information providing device, where the cup position estimation unit estimates, as the cup position, one of the divided sections that serves as a centroid of a distribution where the users were present within the predetermined period.

[Clause 5]

In the information providing device, where the position information memory unit stores the position information of the user obtained by the position information acquisition unit in association with date-and-time information, and the cup position estimation unit estimates, as the cup position, one of the divided sections where movement paths of the users intersected the largest number of times within the predetermined period.

[Clause 6]

In the information providing device, where the cup position estimation unit determines the cup position when the user completes playing at each of holes within the predetermined period.

[Clause 7]

In the information providing device, where the cup position providing unit provides a predetermined cup position or does not provide the cup position when the cup position has not been estimated by the cup position estimation unit within the predetermined period.

[Clause 8]

In the information providing device, including a posture information acquisition unit that obtains posture information of the user, where the cup position estimation unit refers to the posture information of the user obtained by the posture information acquisition unit to estimate, as the cup position, one of the divided sections where the largest number of users have bent down.

[Clause 9]

An information providing system, including:

a position information acquisition unit that obtains position information of a user;

a position information memory unit that stores the position information of the user obtained by the position information acquisition unit;

a cup position estimation unit that estimates a cup position from position information of multiple users stored in the position information memory unit within a predetermined period; and a cup position providing unit that provides the user with the cup position estimated by the cup position estimation unit.

[Clause 10]

An information providing method, including:

obtaining, by one or more computers, position information of a user;

storing, by the one or more computers, the obtained position information of the user;

estimating, by the one or more computers, a cup position from position information of multiple users stored in the position information memory unit within a predetermined period; and providing, by the one or more computers, the estimated cup position to the user.

[Clause 11]

A program that causes one or more computers to execute:

obtaining position information of a user;

storing the obtained position information of the user;

estimating a cup position from position information of multiple users stored in the position information memory unit within a predetermined period; and providing the estimated cup position to the user.

The expression "at least one of" as used herein means "one or multiple" of desired options. For example, the phrase "at least one of" as used in this description means "only one choice" or "both of two choices" in a case in which the number of choices is two. In another example, the phrase "at least one of" as used in this description means "only one single choice" or "any combination of two or more choices" if the number of its choices is three or more.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Appropriate results can be achieved if the sequences are executed in a different order, and/or the configurations within the described system, structure, device, or circuit are combined in a different manner, and/or replaced or supplemented by other components or their equivalents.

What is claimed is:

1. An information providing system, comprising:

at least one non-transitory memory configured to store program code; and one or more processors configured to read the program code and operate as instructed by the program code, the program code including:

position code configured to cause at least one of the one or more processors to obtain, for a golf course including a plurality of greens, position data indicating a position of each of players playing golf on each of the plurality of greens;

posture code configured to cause at least one of the one or more processors to obtain posture data of the players via a position detector for each of the players, storing code configured to cause at least one of the one or more processors to store the position data and the posture data in the at least one non-transitory memory;

estimating code configured to cause at least one of the one or more processors to estimate, from the position data and the posture data stored in the at least one memory, a cup position of where a cup is installed on at least one green from the plurality of greens within an area based on a number of players that have bent down during a play period of the players playing golf; and providing code configured to cause at least one of the one or more processors to provide the estimated cup position to a user of the golf course.

2. The information providing system according to claim 1, wherein the position data indicates the position of each of the players within the area that includes a green where the cup is installed, and the estimating the cup position includes estimating, as the cup position, one of divided sections that are obtained by dividing the area including the green.

3. The information providing system according to claim 2, wherein the estimating the cup position includes estimating, as the cup position, one of the divided sections where the largest number of players were present.

4. The information providing system according to claim 2, wherein the estimating the cup position includes estimating, as the cup position, one of the divided sections that includes a centroid of a distribution of the players.

5. The information providing system according to claim 2, wherein the storing the position data in the at least one non-transitory memory includes storing the position data of each of the players in association with date-and-time data of the player, and the estimating the cup position includes estimating, as the cup position, one of the divided sections where movement paths of the players intersected the largest number of times.

6. The information providing system according to claim 1, wherein the estimating code is further configured to cause at least one of the one or more processors to estimate the cup position based on determining each of the players completes each of holes included in the golf course.

7. The information providing system according to claim 1, wherein the providing code is further configured to cause at least one of the one or more processors to provide a predetermined default cup position or suspending the providing the cup position when the cup position has not been estimated on a specific round day.

8. An information providing method, comprising:

obtaining, by one or more computers having at least one non-transitory memory, for a golf course including a plurality of greens, position data of each of players playing golf on each of the plurality of greens;

obtaining posture data of the players via a position detector for each of the players;

estimating, by the one or more computers, from the position data and the posture data, a cup position of where a cup is installed on at least one green from the plurality of greens within an area based on a number of players that have bent down during a play period of the players playing golf; and providing, by the one or more computers, the estimated cup position to a user of the golf course.

9. A non-transitory computer-readable medium storing a program for causing one or more computers to execute:

obtaining, for a golf course including a plurality of greens, position data of a position of each of players playing golf on each of the plurality of greens;

obtaining posture data of the players via a position detector for each of the players;

estimating, from the position data and the posture data, a cup position of where a cup is installed on at least one green from the plurality of greens within an area based on a number of players that have bent down during a play period of the players playing golf; and providing the estimated cup position to a user of the golf course.

* * * * *